United States Patent [19]

Gautreaux et al.

[11] 3,954,443

[45] May 4, 1976

[54] ALUMINUM PROCESS

[75] Inventors: Marcelian F. Gautreaux; John H. McCarthy; Walter E. Foster; Donald O. Hutchinson; Frederick W. Frey, all of Baton Rouge, La.

[73] Assignee: Ethyl Corporation, Richmond, Va.

[22] Filed: July 1, 1974

[21] Appl. No.: 484,397

Related U.S. Application Data

[63] Continuation-in-part of Ser. No. 277,383, Aug. 2, 1972, Pat. No. 3,860,415.

[52] U.S. Cl. ..... 75/3; 75/68 A

[51] Int. Cl.[2] ..... C22B 1/08; C22B 21/02

[58] Field of Search ..... 75/3–5, 75/68

[56] References Cited

UNITED STATES PATENTS

| | | | |
|---|---|---|---|
| 3,116,997 | 1/1964 | Kohlmeyer | 75/68 A |
| 3,228,763 | 1/1966 | Herkenhoff | 75/3 |
| 3,337,328 | 8/1967 | Lawver | 75/3 |
| 3,418,107 | 12/1968 | Carr | 75/1 |
| 3,578,436 | 5/1971 | Becker | 75/68 C |
| 3,770,789 | 11/1973 | Ichiki | 75/68 C |
| 3,784,372 | 1/1974 | Scull | 75/68 C |
| 3,788,834 | 1/1974 | Hildreth | 75/1 |

*Primary Examiner*—Peter D. Rosenberg
*Attorney, Agent, or Firm*—Donald L. Johnson; John F. Sieberth; Paul H. Leonard

[57] ABSTRACT

A process for producing aluminum from raw aluminum silicate ore, especially kyanite, including comminuting a natural or raw mined kyanite ore to a desired particle size, beneficiating the ore to form a kyanite concentrate, compacting the concentrate along with a carbon reductant into agglomerates such as briquettes, pellets or other suitable form and to a desired size, carbothermically reducing the compacts in an electric arc furnace into an aluminum-silicon alloy, comminuting the aluminum-silicon alloy into a desired particle size, reacting the aluminum-silicon alloy particles with hydrogen and propylene to form tripropylaluminum and dipropylaluminum hydride, pyrolyzing or decomposing the tripropylaluminum and dipropylaluminum hydride in an oil medium or bath to form an aluminum powder, filtering, washing and drying the aluminum powder, and fluxing and casting the aluminum powder into pigs or other suitable form, thereby forming a substantially pure aluminum product.

In a preferred process, slag and fume produced from the carbothermic reduction of the kyanite concentrate in the electric arc furnace are transferred to the compaction operation, hydrogen and propylene produced in the decomposition phase are routed to the hydroalumination reaction, and oil from the washing and drying of the aluminum powder is circulated to the decomposition step. In a most preferred process, the silicon rich residue from the hydroalumination reaction is conducted to a furnace wherein lime, silicon-dioxide and iron, if necessary, are added to produce ferro-silicon alloy.

19 Claims, 1 Drawing Figure

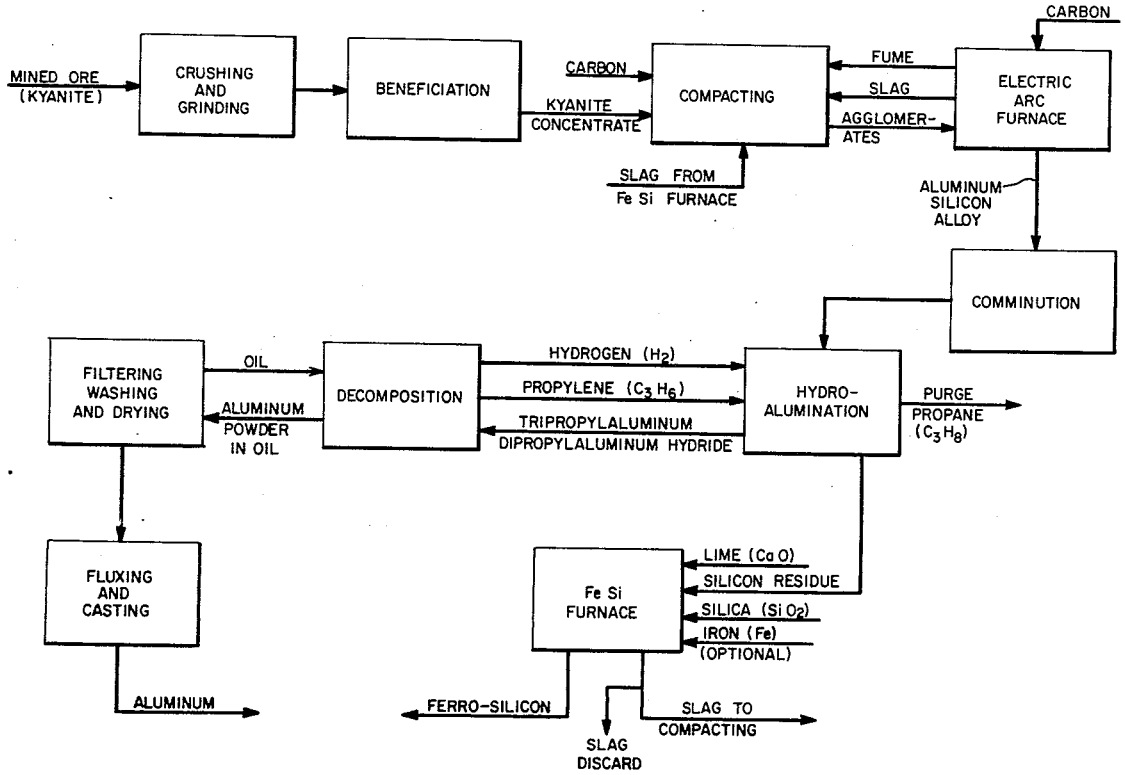

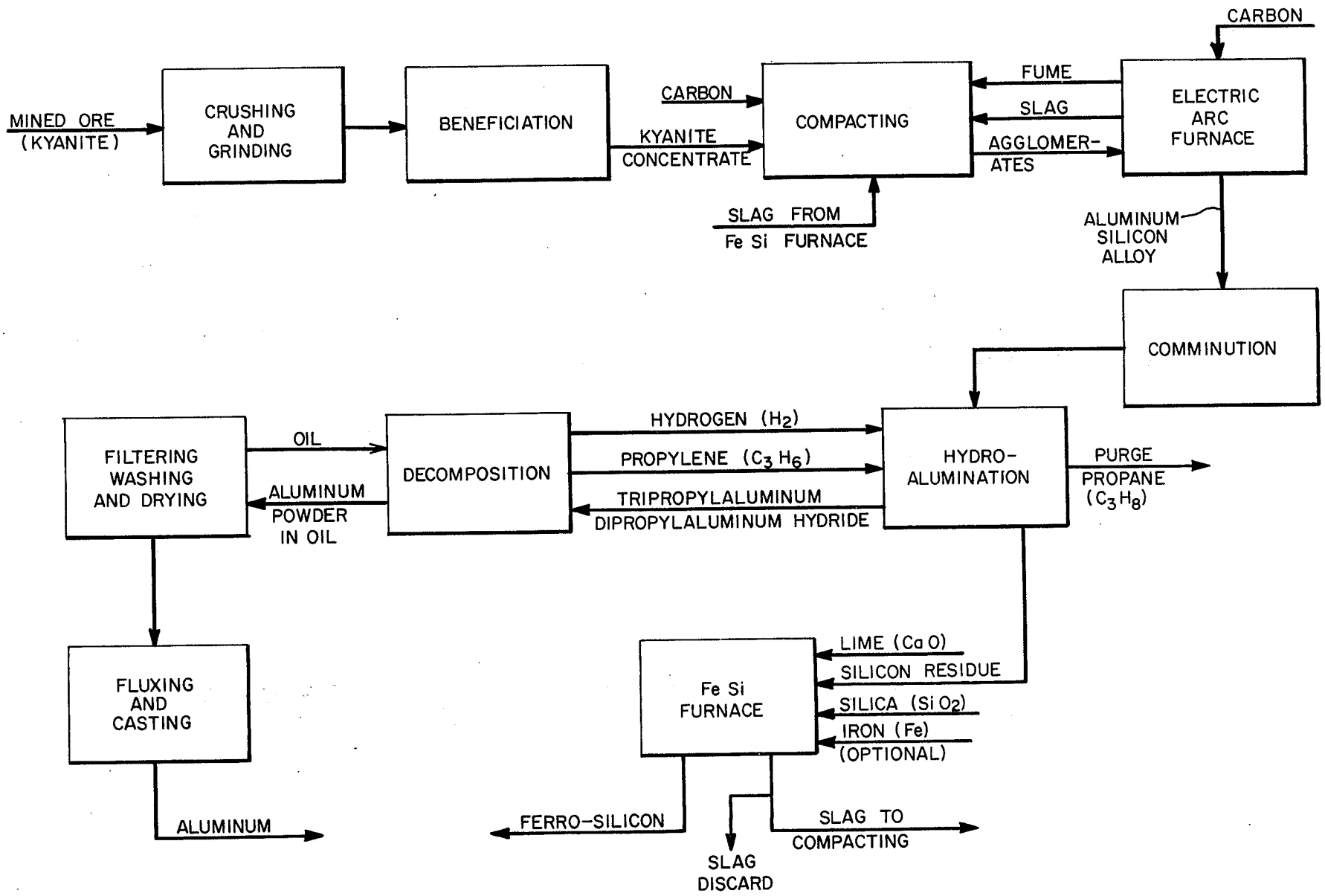
CARBON
ELECTRIC ARC FURNACE
ALUMINUM SILICON ALLOY
COMMINUTION
FUME
SLAG
AGGLOMER-ATES
COMPACTING
SLAG FROM Fe Si FURNACE
CARBON
KYANITE CONCENTRATE
BENEFICIATION
CRUSHING AND GRINDING
MINED ORE (KYANITE)
PURGE
PROPANE ($C_3H_8$)
HYDRO-ALUMINATION
HYDROGEN ($H_2$)
PROPYLENE ($C_3H_6$)
TRIPROPYLALUMINUM
DIPROPYLALUMINUM HYDRIDE
DECOMPOSITION
OIL
ALUMINUM POWDER IN OIL
FILTERING WASHING AND DRYING
FLUXING AND CASTING
ALUMINUM
LIME (Ca O)
SILICON RESIDUE
SILICA ($Si O_2$)
IRON (Fe) (OPTIONAL)
Fe Si FURNACE
SLAG TO COMPACTING
SLAG DISCARD
FERRO-SILICON

ALUMINUM PROCESS

CROSS-REFERENCE TO RELATED APPLICATION

This application is a continuation-in-part of application Ser. No. 277,383, filed Aug. 2, 1972, now U.S. Pat. No. 3,860,415.

BACKGROUND OF THE INVENTION

The present invention is in the field of aluminum extraction and reduction and particularly relates to a direct-reduction process for producing aluminum from a raw or natural aluminum silicate ore such as kyanite and sillimanite.

For over 80 years, aluminum has been produced by the twopart Bayer-Hall process, wherein alumina ($Al_2O_3$) is first extracted from bauxite ore and the alumina is then electrolytically reduced in molten cryolite (sodium aluminum fluorides) to free aluminum metal. Although the process has been highly successful commercially, it consumes large quantities of electricity and takes about four pounds of bauxite to produce one pound of aluminum. Bauxite comprises 45 to 60 percent aluminum oxide, 3 to 25 percent iron oxide, 2.5 to 18 percent silicon oxide, 2 to 5 percent titanium oxide, up to one percent other impurities, combined with 12 to 30 percent "water of crystallization." The ore varies greatly in the proportions of its constituents, and in color and consistency. Gibbsite, boehmite and diaspore are the hydrated aluminum oxide minerals normally found in bauxite.

The Bayer process for producing alumina basically involves a caustic leach at elevated temperature and pressure, followed by separation of the resulting sodium aluminate solution, and selective precipitation of the alumina. There are two principal variations of the process: (1) The European Bayer, in which the approximate conditions of leaching are at a pressure of 210 pounds per square inch, a temperature of 390°F, a caustic concentration of 400 grams per liter, and a digestion time of 2 to 8 hours to effect solution of the monohydrate mineral boehmite; and (2) The American Bayer, in which a pressure of about 60 pounds per square inch, a temperature of about 290°F, a caustic concentration of 170 grams per liter, and a digestion time of one-half to 1 hour are used to dissolve the trihydrate mineral gibbsite. In both processes, the pregnant solution is separated from the red mud tailings by countercurrent decantation and filtration. The liquor is cooled until it becomes supersaturated, then seeded with crystals of aluminum trihydrate. About one-half of the alumina in solution is precipitated in a 36 to 96 hour period. The precipitate is then filtered, washed and calcined at 2000°F to obtain the final product. Caustic soda is regenerated in the precipitation step and, together with the unprecipitated alumina, is recycled to the digesters.

The finely divided residue resulting from leaching contains $Fe_2O_3$, $TiO_2$ and a complex sodium aluminum silicate compound, the latter representing a loss of soda and alumina. The quantity discarded in the residue is related to the silica content of the bauxite. Approximately 1.1 units of alumina and 1.2 units of soda are lost for each unit of silica in the ore. For economic treatment, the bauxite must contain less that 8 percent silica. Approximately 4 long dry tons of bauxite are required to produce two short tons of alumina, which upon electrolysis yields slightly more than 1 short ton of aluminum. In addition to bauxite, the Bayer process requires soda ash, lime for causticizing the soda ash and fuel oil, gas or coal.

Some modifications of the Bayer-Hall process have been made in order to utilize bauxite ores containing 12 to 15 percent silica. In one such process the ore is first subjected to a Bayer leach. The resulting red mud, which contains a complex sodium aluminum silicate compound, is sintered with limestone and soda ash, then leached with water to recover alumina and soda. The brown mud residue has a composition, on a dry basis, somewhat similar to that of portland cement. This process requires additional costs in capital investment, raw materials and processing, and the upper limit of silica for use in the process is about 15 percent.

The average grade of bauxite ore used in the Bayer-Hall process has continually declined. In 1930 ore used in the U.S. averaged 60 percent alumina and by 1963, the average was less than 50 percent alumina. Although it is anticipated that this average will decrease to about 35 percent alumina in the future, the process is generally limited to the use of bauxite ore high in aluminum content. Domestic reserves of such high grade are totally inadequate to meet current production requirements.

Another disadvantage of the Bayer-Hall process is its necessity for an adequate, dependable and long-range supply of alumina requiring discovery of new sources of raw materials and the solution of numerous mining and metallurgical problems. Problems of the process include the need for improving efficiency and development of methods for utilizing tailings. Mechanical beneficiation of low-grade bauxites is hampered by the high loss of alumina in removing iron and silica. A need therefore exists for a direct reduction process that frees aluminum from crude feed material and which material is readily available.

In another process, alumina is extracted commercially from high-iron bauxites by the Pedersen smelting process. In this process, bauxite, limestone, coke and iron ore are smelted in an electric furnace to produce pig iron and a calcium aluminate slag containing 30 to 50 percent alumina. The slag is leached with sodium carbonate solution, and the alumina trihydrate is precipitated by carbon dioxide.

One prior art direct reduction process for producing alumina has achieved some success in the laboratory, but has failed to achieve real commercial sucess. In this process, aluminum-containing metal feed, e.g., bauxite reduced with coke, is brought into contact at an elevated temperature with gaseous $AlCl_3$ (or the tribromide) and the gaseous subhalide (monochloride or monobromide) is cooled in a separate zone to break the gas down to aluminum trihalide and purified aluminum. Aluminum is recovered in a molten, substantially pure state. The aluminum trihalide is recirculated to produce additional mono-halide. Severe temperature conditions, problems of handling hot metal, and the corrosive nature of the gases create many difficulties in operating the process.

In another direct reduction process, bauxite is partially reduced with carbon in an electric furnace, then it is further reduced with carbon to produce a mixture of aluminum and aluminum carbides. The aluminum is separated and the aluminum carbide recycled. Little or no commercial success has been achieved with this process.

Many other methods of recovering aluminum have been proposed, none of which have been particularly successful. Such processes include the treatment of alumina with aluminum sulfide and carbon at an elevated temperature; hydrogen reduction of alumina at above 100 atmospheres and above 400°C; reaction between alumina and aluminum carbide at 1,980°C; and electrolytic reduction of complex organoaluminum compounds such as $NaF \cdot 2Al(C_2H_5)_3$.

Another process comprises chlorinating alumina containing materials in a reactor to yield aluminum trichloride and reacting the aluminum trichloride with manganese to yield aluminum and manganese chloride.

A process for carbothermic production of aluminum from aluminum oxide is disclosed in U.S. Pat. No. 3,607,221.

Direct smelting of aluminum-silicon alloys from clay has been investigated. High-purity clay is used to minimize contamination of the alloy by iron and titanium. An electric furnace has been used with a carbon reductant, which may be coke, charcoal, sawdust, hogged fuel, or mixtures of these materials. At operating temperature, pure aluminum would volatize and react with oxides of carbon. This is prevented by the presence of silicon which alloys with the aluminum and reduces the amount of aluminum vapors that are produced. Further, the silicon preferentially reacts with any carbon which dissolves in the aluminum silicon alloy and prevents the formation of aluminum carbide which would be non-reactive in aluminum recovery operations.

Methods for recovering commercial-grade aluminum from aluminum-silicon alloys have also been investigated. Experimental procedures have included leaching the alloy with a molten metal such as zinc in which the aluminum dissolves and the silicon and impurities are relatively insoluble. The zinc is then distilled from the aluminum. In the subhalide process, a crude aluminum alloy is treated with $AlCl_3$ at approximately 1000°C to produce AlCl. The reaction is reversed by lowering the temperature; pure aluminum condenses and the $AlCl_3$ vapors are recycled.

The present invention is particularly adapted to overcome the disadvantages, problems and difficulties of these prior art processes.

It is a primary object of the present invention to provide a complete direct reduction process for producing aluminum from a natural or raw ore, such a kyanite, which is available domestically in commercial quantities.

Another object of the present invention is to provide a process for producing substantially pure aluminum which is more economical than prior art processes.

Still another object of the present invention is to provide a process for producing aluminum wherein little or none of the materials used therein is lost in processing A further object of the instant invention is to provide a new direct reduction process for aluminum which also provides a ferro-silicon alloy as a second principal product thereof.

Other objects and advantages of the invention will be readily apparent from a consideration of the description and drawings hereinafter.

SUMMARY OF THE INVENTION

The present invention provides a process for producing substantially pure aluminum from mined aluminum silicate ore, especially kyanite ore and comprises the following basic steps:

1. The mined kyanite ore is crushed and ground in suitable equipment or otherwise comminuted to a particle size of about 600 microns to about 44 microns and preferably less than about 500 microns or about −35 mesh.
2. The ground kyanite ore is beneficiated to form a kyanite concentrate. A kyanite flotation process is preferred. The ground kyanite ore is subjected first to a scrubbing and desliming process for removing fine particles, i.e. those particles that are so fine as to interfere with flotation. The ground kyanite ore is then subjected to a combination flotation and magnetic separation treatment. A density and/or particle shape separation such as tabling can be employed if desired. The kyanite is non-magnetic. In some instances, the ground kyanite ore can be subjected to a reductive roast and further magnetic separation to remove residual iron containing minerals. The particular beneficiation process will vary with the type of ore.
3. The kyanite concentrate is then compacted into agglomerates. Briquettes of from about 1 inch × 1½ inches × ¾ inch to about 2 inches × 2 inches × 1 inch formed in suitable briquetting or like equipment utilizing suitable binders have been found to be particularly satisfactory. Mixed briquettes of carbon and kyanite are preferred. Pellets or other suitable agglomerates may also be used. Separate feeds of carbon and kyanite briquettes are also suitable.
4. The carbon-kyanite briquettes are then fed to an electric arc furnace. If necessary a predetermined amount of additional carbon in the form of coal, coke, charcoal and/or wood chips is added along with the kyanite. In the furnace, the kyanite is carbothermically reduced to form an aluminum-silicon alloy.
5. As tapped the aluminum-silicon alloy contains non-metallic impurities consisting of unreduced metal oxides and metal carbides. These non-metallic impurities are removed from the metal by cooling the raw alloy to about 1100°C under a layer of protective flux. The non-metallic impurities or slag are granulated and recycled to the agglomerating operation.
6. The aluminum-silicon alloy is then comminuted to a particle size of from about 150 microns to about 10 microns. A powder with a medium particle size of about 100 microns is particularly desirable. The alloy may be cast and ground to the desired size, blown from the melt, or comminuted by water spray.
7. The aluminum-silicon alloy particles are transferred to a suitable reactor and treated with propylene and hydrogen and a sodium catalyst under desired temperatures and pressures to form tri-n-propylaluminum (TNPA) and di-n-propylaluminum hydride (DNPAH). Some TNPA may be used to initiate the hydroalumination reaction.
8. The TNPA and DNPAH are pyrolyzed or decomposed in an inert diluent such as a hydrocarbon oil in a suitable reactor to form aluminum powder, propylene and hydrogen. Some propane is produced in the pyrolysis. Although the propane may be separated and recovered, preferably most of it is compressed along with the propylene and hydrogen and fed back to the hydroalumination reactor. After the hydrogen and propylene have reacted, the propane from pyrolysis and any propane produces as a by-product of hydroalumination are vented.

9. The aluminum powder is filtered and washed with a light hydrocarbon or oil such as hexane and then dried and compacted into a desired form or shape. The diluent oil is separated from the wash and preferably recycled to the decomposition step. The process can also be ended here.
10. The aluminum powder compacts are then melted and fluxed with chlorine gas or metal chlorides and fluorides, and then cast into pigs, sows or other desired shapes. A flux comprised of sodium chloride, potassium chloride and cryolite is expecially beneficial, but other suitable fluxes may be used. In gas fluxing, chlorine gas is bubbled into the molten metal. Preferably an inert gas carrier, such as nitrogen is used. A most preferred fluxing gas is chlorine plus carbon monoxide and nitrogen.
11. In the preferred form of the process, silicon residue, which is filtered from the hydroalumination product, is heated to about 1600°C in a suitable furnace with calcium oxide, silicon dioxide and if needed, additional iron to produce a ferro-silicon alloy of a desired ratio of silicon and iron. The alloy is separated from slag and cast into chills, pigs, sows, or other desired shapes.

BRIEF DESCRIPTION OF THE DRAWING

The drawing illustrates a flow diagram of the complete process for producing pure aluminum and ferro-silicon alloy.

DESCRIPTION OF THE PREFERRED EMBODIMENT

A raw kyanite ore containing more than 10 percent kyanite is employed in the process. One typical ore averages by weight about 20% kyanite, 20% quartz, 40% mica, 10% garnet, includes some pyrite and lesser amounts of other minerals. After the ore is mined, it is transferred to a suitable crusher, such as a jaw crusher, wherein the raw ore is reduced to about −4 inches. The crushed ore is transferred to a secondary crusher and then to an open circuit wet rod mill. A closed circuit wet ball mill is used to grind the ore to a final size of about minus 35 mesh.

It can be appreciated that kyanite ores vary widely in their associated minerals. Other forms of comminution may be employed, but it is important that said final ore size be obtained.

The comminuted or pulverized ore is then beneficiated via flotation circuits for the removal of various micas, pyrites and quartz sand. The remaining iron containing minerals are separated from the kyanite concentrate with high intensity magnetic separation. Process waters from the beneficiation process are recycled.

In the beneficiation process up to about 90% of the kyanite is recovered. A typical concentrate composition is about 59% $Al_2O_3$, 38% $SiO_2$, 0.7% $Fe_2O_3$ and 0.3% $TiO_2$, by weight. A suitable concentrate composition ranges from about 55–60% $Al_2O_3$, 35–40% $SiO_2$, up to 1% $Fe_2O_3$, and up to 1% $TiO_2$.

After the kyanite concentrate is prepared, it is then briquetted along with sufficient carbon to provide a suitable furnace feed. Pillow shaped briquettes of a size of about 2 inches by 2 inches by one inch are preferred. Agglomeration of the finely ground kyanite is necessary for good furnace operation. In a preferred from of the process, fume from the electric arc furnace is recycled to the briquetting operation where it is used as a binder and subsequently fed back into the arc furnace. Slag from the furnace is also recycled to the briquetting operation. Reducing agents are mixed with the ore and slag prior to briquetting. Coke and coal fines are used. The fixed carbon in the reducing agents should supply about 90–110 percent of the theoretical carbon required for reduction and preferably 95–105 percent. If carbon is added separately, the fixed carbon content of a typical carbon feed is about 12% wood, 60% coal and 28% coke. Other proportions are suitable. Under some circumstances wood is not necessary.

The briquettes of kyanite concentrate and carbon are then transferred to an electric arc furnace for reduction to an aluminum-silicon alloy. Aluminum-silicon alloy is tapped from the furnace. As tapped from the furnace, the aluminum-silicon alloy contains unreduced metal oxides and carbides. These non-metallic compounds are removed from the raw alloy by cooling it to about 1100°C under a blanket of flux. A salt flux comprising a mixture of sodium chloride, potassium chloride and cryolite is especially preferred. About one pound of flux is used per 10 pounds of crude alloy. The slag is separated from the cleaned metal and recycled to the agglomerating or briquetting operation. The cleaned aluminumsilicon alloy typically contains by weight, about 58% Al, 37.5% Si, 1.5% Fe, 0.4% Ti and 2% non-metals.

The cleaned alloy is then comminuted to a conventional size for hydroalumination. The large castings may be transferred directly to a large crusher or impact mill where they are reduced to −6 inch lumps, or they may be broken up by a concrete breaker, jack hammer or other suitable equipment to lumps or pieces of about 6 inches. The small pieces of alloy are then submitted to secondary crushing techniques in conventional equipment until they are reduced to particles of about ¼ inch. Finally, the small particles of crushed alloy are fed to a ball mill and further reduced to about a −100 mesh powder. The ground alloy is then conveyed to a hydroalumination reactor for further processing. Care is taken to minimize oxygen exposure during the grinding operation, so that aluminum metal is not oxidized to $Al_2O_3$.

A tri-n-propylaluminum (TNPA) hydroalumination process is used to separate aluminum from the silicon in the alloy. Hydroalumination may be carried out in a continuous process, wherein hydrogen and propylene and some TNPA and a suitable catalyst, e.g., sodium, are continuously introduced into a hydroalumination reactor along with a stream of alloy to produce tri-n-propylaluminum (TNPA) and di-n-propylaluminum hydride (DNPAH). After a suitable residence time in the reactor TNPA and DNPAH product is filtered or centrifuged and is transferred to a pyrolysis or decomposition reactor. In a preferred hydroalumination step, several reactors are used with alloy being fed to the first one or two at a controlled rate under controlled conditions. Propane formed in the pyrolysis step, as well as during the hydroalumination operation, is vented and used for fuel. Depletion of free aluminum is the alloy is in excess of 90%. Preferably, silicon residue from the hydroalumination reaction is removed from the TNPA via suitable filtration, e.g., a horizontal leaf filter using diatomaceous earth for filter aid, and transferred to a furnace for making ferro-silicon alloy.

The pyrolysis or decomposition of the TNPA-DNPAH mixture is carried out in a series of reactors in an inert hydrocarbon medium. Hydrogen and olefin (propylene) as well as by-product paraffin (propane) produced are transferred to the hydroalumination reactor. Propylene recovery is in excess of 90%. The propane produced may be separated and recovered, preferably most of it is compressed along with the propylene and hydrogen and fed back to the hydroalumination reactor. After the hydrogen and propylene have reacted, the propane from pyrolysis and any propane produced as a by-product of hydroalumination are vented.

Aluminum is produced in the form of powder in the oil slurry. The aluminum-oil mixture is filtered, with the aluminum being separated therefrom, washed with hexane and dryed. The oil or inert hydrocarbon and aluminum alkyl mixture is recycled to the pyrolysis reactor. The hexane-oil-aluminum alkyl mixture from the wash step is flashed and substantially all of the hexane is recovered.

The hexane-wet aluminum powder is dried in any suitable manner, e.g., in steam-tube dryers. Vaporized liquids are condensed and recycled to the wash recovery operation. Oxygen exposure of the fresh aluminum surface is minimized during the washing and drying operations.

The dry aluminum powder is briquetted and fed to a conventional melting furnace. Fluxing is desirable and a flux composition of 60% sodium chloride and 40% cryolite, by weight, produces excellent results. A gas flux, such as chlorine, or any other suitable flux may be used. Molten pure aluminum from the melting furnace is cast into suitable ingots. A direct chill ingot casting machine is preferable, but other casting apparatus may be used.

In the preferred process of this invention, ferro-silicon alloy is also produced as co-product. Silicon residue powder from the filtration of the TNPA is mixed with iron, normally in the form of steel turnings, quartz and limestone and fed into a slag resistance furnace or other suitable furnace operated at 1600°C to produce a ferro-silicon alloy. Molten ferro-silicon alloy is tapped from the furnace periodically and cast into suitable containers for further handling as desired. A typical ferro-silicon alloy is by weight about 85% Si, 1% Ti and the balance Fe.

Slag produced from the ferro-silicon furnace is also cast and subsequently crushed to particles of about −¼ inch. The crushed and ground slag is then preferably recycled to the kyanite briquetting plant, but may be disposed of if desired.

The silicon residue contains up to 0.2 pounds of aluminum per pound of silicon. The aluminum content of the residue must be reduced to 0.01–0.03 pounds of aluminum per pound of silicon to produce a satisfactory ferro-silicon product. The aluminum is removed by reacting it with quartz ($SiO_2$) to form alumina and silicon. The reaction reaches equilibrium somewhat short of complete aluminum removal and it is necessary to use excess $SiO_2$. The limestone provides calcium oxide which reduces the melting point of the furnace slag. The composition of the slag is critical to the proper operation of the process. The $SiO_2$ content must be less than 50% to keep the slag viscosity low. The alumina content should be less than 30% to promote the reaction between the slag and the aluminum in residue and to maintain a low slag density.

The hydroalumination reaction for producing aluminum alkyls is an exothermic one and some of the simultaneous reactions proceed at a faster rate than others. The reaction also produces paraffins. In a commercial operation, it is necessary that the rate of reaction be sufficiently fast to minimize the size of equipment needed and to reduce paraffin formation relative to the rate of formation of aluminum alkyls.

Some aluminum alkyls decompose cleanly during pyrolysis while others do not. Some produce considerably more carbides than others, and some produce quantities of undesirable by-product olefins and paraffins.

In comparison of TNPA with triethylaluminum (TEA), hydroalumination is faster with TEA and less paraffins are produced. In commercial practice however, the benefit of the faster rate in hydroalumination of TEA cannot be capitalized on because the reaction becomes heat transfer limited rather than kinetics limited. The reaction is highly exothermic and heat must be removed. The reaction must be conducted at a rate which permits transffer of the evolved heat out of the system. Furthermore, TEA does not decompose cleanly, produces more carbides and produces substantial amounts of butenes during decomposition or pyrolysis.

In comparison of TNPA with triisobutylaluminum (TIBA), hydroalumination reaction rates on a molar basis are about the same; however, the aluminum carrying power of TIBA is considerably lower than that of TNPA. Since the densities are nearly the same for each of said alkyls, then because of molecular weight differences (156 for TNPA and 198 for TIBA), a given reactor will solubilize only 79% of the aluminum in Al-Si alloy via TIBA than will be solubilized with TNPA. Thus, in order to react out the same quantity of aluminum with TIBA, the hydroalumination reactor has to have a 25% greater capacity, substantially increasing the investment cost.

In further comparison of TNPA and TIBA, the paraffin formation rates are about the same on a molar basis. Since the molecular weight of paraffin from TIBA is greater than that of paraffin from TNPA, more pounds of paraffin are formed per pound of aluminum produced when TIBA is decomposed.

Although TIBA decomposes fairly cleanly, carbide production is somewhat higher with TIBA than with TNPA.

From the above considerations, TNPA is the preferred intermediate over TEA and TIBA in the aluminum process described herein.

This invention is particularly directed to the use of aluminum silicate ores which contain substantial amounts of aluminum and silicon. Economically, the raw ore should contain at least 15% of a sillimanite group mineral. Kyanite, sillimanite and andalusite are the principal minerals comprising the sillimanite group of ores or minerals. For simplification and purposes herein a kyanite ore is defined as any aluminum silicate ore which contains 15% or more of a mineral having equal numbers of moles $Al_2O_3$ and $SiO_2$. Under some circumstances, a raw ore containing as little as 12% of the desired minerals is suitable. A kyanite concentrate is defined as a kyanite ore which has been beneficiated to remove substantial amounts of impurities or materials other than kyanite.

The foregoing disclosure and description of the invention is illustrative and explanatory thereof and various changes may be made in the details of process within the scope of the appended claims without departing from the spirit of the invention.

What is claimed is;

1. A process for producing substantially pure aluminum from a raw kyanite ore, comprising, in sequence, the steps of:

a. comminuting the raw kyanite ore into particles about minus 35 mesh in size, then beneficiating the ore particles via flotation to remove micas, pyrites and quartz sand, and then magnetically separating the iron containing minerals from the product to form a particulated kyanite concentrate;

b. agglomerating the particulated kyanite concentrate into ore compactions of a predetermined size and shape;

c. carbothermically reducing the ore compactions in an electric arc furnace to produce an aluminumsilicon alloy, slag and effluent fume, and recycling said slag and effluent fume to the agglomerating step;

d. comminuting the aluminum-silicon alloy to a particle size of about minus 100 mesh;

e. subjecting the particulated aluminum-silicon alloy to hydroalumination with propylene, hydrogen and a sodium catalyst to form tripropylaluminum and diporpylaluminum hydride and silicon residue; separating said aluminum alkyls and said silicon residue; heating said silicon residue in a furnace with calcium oxide, silicon dioxide and iron as needed to produce a ferrosilicon alloy of a desired ratio of silicon and iron and a quantity of slag; and separating the ferro-silicon alloy from the slag and casting it into a desired shape; and, f. pyrolyzing the mixture of tripropylaluminum and dipropylaluminum hydride in an inert diluent to produce substantially pure aluminum powder, propylene and hydrogen; recovering the propylene and hydrogen and transferring them to the hydroaluminating step.

2. The process of claim 1, including the additional step of:

h. compacting the aluminum powder into a desired form, melting the aluminum powder compacts in the presence of a fluxing agent and casting the molten aluminum metal into a desired shape, thereby forming a substantially pure casting of aluminum metal.

3. The process of claim 1, wherein the silicon residue produced in step (e), the hydroalumination step, is heated to about 1600°C.

4. The process of claim 1, wherein the slag produced from the ferro-silicon furnace is comminuted to a desired particle size and recycled to the agglomerating step (b) of claim 1.

5. The process of claim 1, wherein process waters from the flotation operation are recycled.

6. The process of claim 1, wherein the agglomerates are pillow shaped briquettes of a size of about two inches by two inches by 1 inch.

7. The process of claim 1, wherein the kyanite compactions are fed into the electric arc furnace with an amount of carbon of from about 90% to about 110% of the theoretical carbon necessary for effective reduction of the ore compactions.

8. The process of claim 1, wherein the carbon feed comprises coal, coke and wood.

9. The process of claim 1, wherein the fixed carbon content of the carbon feed is about 12% wood, 60% coal and 28% coke.

10. The process of claim 1, wherein the carbon feed is a mixture of coke and coal.

11. The process of claim 1, wherein the inert diluent is a hydrocarbon.

12. The process of claim 1, wherein the molten aluminumsilicon alloy produced in the electric arc furnace is periodically tapped therefrom and refined by holding it at a temperature of about 1100°C–1200°C under a flux comprising NaCl, KCl and cryolite.

13. The process of claim 1, wherein after step (c) and before step (d), the crude aluminum-silicon alloy is cleaned by holding it at a temperature of about 1100°C to about 1200°C under a flux.

14. The process of claim 1, wherein carbon is agglomerated with the particulated kyanite concentrate to form mixed compactions of kyanite and carbon.

15. The process of claim 1, wherein the agglomerates contain only kyanite concentrate and carbon is separately added to the electric arc furnace.

16. The process of claim 1, wherein the furnace feed is comprised of mixed compactions of carbon and kyanite, and additional quantities of carbon.

17. The process of claim 1, wherein the silicon dioxide is in the form of quartz and the calcium oxide is in the form of limestone.

18. The process of claim 1, wherein the iron is in the form of steel turnings.

19. The process of claim 1, including the additional step of:

g. filtering, washing and drying the substantially pure aluminum powder thereby separating the inert diluent used in the pyrolyzing step from the aluminum powder and recycling said inert diluent to said pyrolyzing step.

* * * * *